US007023127B2

(12) United States Patent
Hiramatsu

(10) Patent No.: US 7,023,127 B2
(45) Date of Patent: Apr. 4, 2006

(54) MULTI-POINT SPARK PLUG

(75) Inventor: Hiromi Hiramatsu, Kariya (JP)

(73) Assignee: Denso Corporation, Kariya (JP)

( * ) Notice: Subject to any disclaimer, the term of this patent is extended or adjusted under 35 U.S.C. 154(b) by 169 days.

(21) Appl. No.: 10/814,301

(22) Filed: Apr. 1, 2004

(65) Prior Publication Data

US 2004/0195949 A1 Oct. 7, 2004

(30) Foreign Application Priority Data

Apr. 1, 2003 (JP) ..... 2003-098509
Feb. 12, 2004 (JP) ..... 2004-034742

(51) Int. Cl.
*H01T 13/20* (2006.01)

(52) U.S. Cl. ..... 313/140; 313/141

(58) Field of Classification Search ..... 313/118, 313/128, 135, 136, 140, 141, 144
See application file for complete search history.

(56) References Cited

FOREIGN PATENT DOCUMENTS

JP 50-14933 2/1975
JP 57-208084 12/1982

*Primary Examiner*—Vip Patel
(74) *Attorney, Agent, or Firm*—Nixon & Vanderhye P.C.

(57) ABSTRACT

The present invention relates to a multi-point spark plug capable of facilitating the attachment of a plug cap. The multi-point spark plug is made up of two center electrodes, an insulator for accommodating the center electrodes, a housing for holding the insulator and earth electrodes located at one end portion of the housing and each disposed in opposed relation each of the center electrodes in a state where a discharging gap is interposed therebetween. Moreover, first and second terminals to be electrically connected to the center electrodes are provided in a head portion of the insulator. In an outside configuration composed of the head portion and the first and second terminals, a contour between a location of the second terminal and a location of the first terminal is formed axis-symmetrically with respect to an axis of the head portion.

12 Claims, 13 Drawing Sheets

MULTI-POINT SPARK PLUG

BACKGROUND OF THE INVENTION

1) Field of the Invention

The present invention relates to a spark plug for an internal combustion engine which ignites an air-fuel mixture in a combustion chamber, and more particularly to a multi-point spark plug including a plurality of center electrodes.

2) Description of the Related Art

For example, as disclosed in Japanese Patent Laid-Open No. SHO 57-208084, there has been known an ignition device for an internal combustion engine having a center electrode and a third electrode disposed in parallel with the center electrode.

In addition, as shown in FIG. 20, there has been designed a multi-point spark plug 100 having a pair of center electrodes. This multi-point spark plug is made up of an insulator 104 internally including two center electrodes 102 and 103 in a parallel configuration, a housing 105 for holding the insulator 104 and two earth electrodes 106 and 107 located at one end portion of the housing 105 and disposed in opposed relation to the tip surfaces of the center electrodes 102 and 103 in a state where a discharging gap is interposed therebetween. Moreover, two terminals 121 and 122, respectively connected electrically to the two center electrodes 102 and 103, are put in two axial holes 111 and 112 made in the insulator 104, respectively.

There is a problem which arises with the above-mentioned multi-point spark plug 100, however, in that, since the two terminals 121 and 122 are respectively placed in the two axial holes 111 and 112 made in the insulator 104, difficulty is encountered in making a connection easily to a plug cap. This will be described hereinbelow with reference to FIG. 21.

FIG. 21 is an illustration of a plug cap 130 to be connected to the multi-point spark plug 100 shown in FIG. 20. This plug cap 130 is composed of a blind-end cylindrical cap portion 131 to be set to cover up (cap) a head portion 114 of the multi-point spark plug 100, and an ignition coil portion 132 for generating a voltage to be applied to the multi-point spark plug 100.

A first contact terminal 133 and a second contact terminal 134, each of which comprises a spring provided at a tip surface of a bar-like base, protrude from a bottom surface of the cap portion 131, and the first and second contact terminals 133 and 134 are brought into contact with the first and second terminals 121 and 122 of the multi-point spark plug 100, respectively, thereby supplying a voltage to the multi-point spark plug 100.

The ignition coil portion 132 has a box-like casing for internally accommodating an ignition coil, and a fitting hole 139 is made in one side surface of the casing 138 so as to permit the insertion of a bolt thereinto.

Secondly, a description will be given hereinbelow of the attachment (connection) of the plug cap 130 to the multi-point spark plug 100. The multi-point spark plug 100 is fixedly secured to an engine in a manner such that a male screw 108 formed in the housing 105 is put into a threaded engagement with a female screw formed in a cylinder head (not shown). The plug cap 130 is set to cover the head portion 114 of the multi-point spark plug 100. At this time, the first contact terminal 133 and the second contact terminal 134 are inserted into the axial holes 111 and 112, respectively. Following this, a bolt (not shown) is inserted into the fitting hole 139 attached to the casing 138, and this bolt is placed into a threaded engagement with a female screw set on the cylinder head (not shown), thus fixedly securing the plug cap 130 thereto.

However, in the case of this multi-point spark plug 100, for setting the plug cap 130, there is a need to insert the first contact terminal 133 and the second contact terminal 134 into the axial holes 111 and 112. Therefore, it needs that, after the plug cap 130 and the multi-point spark plug 100 are disposed so that their axes align with each other, the plug cap 130 is rotated around its axis to align the first contact terminal 133 with the axial hole 111 and further to align the second contact terminal 134 with the axial hole 112 and the plug cap 13 is pushed into the multi-point spark plug 100 to be fitted thereto. This makes it difficult to accomplish the attachment of the plug cap 130 easily.

In addition, since the attachment of the multi-point spark plug 100 is made in a manner such that the male screw 108 formed in the housing 105 and the female screw formed in the cylinder head are placed into engagement with each other, the positions of the axial holes 111 and 112 do not settle when the multi-point spark plug 100 is fixedly secured to the cylinder head. This is because, when two members are fixedly coupled to each other through screws, the relative positions of the male screw side member and the female screw side member in rotating directions vary according to the tightening torque and, even if the tightening torque is controlled to stand at a constant value, the precise screw processing is a necessity to making the rotating-direction relative positions constant. Thus, in a case in which the positions of the axial holes 111 and 112 do not settle, the position of the fitting hole 139 attached to the plug cap 130 engaging with the axial holes 111 and 112 does not settle. For this reason, the fitting hole 139 does not necessarily align with the position of the female screw formed in the cylinder head and, hence, difficulty is experienced in fixedly securing the plug cap 130 through the use of a bolt.

SUMMARY OF THE INVENTION

The present invention has been developed with a view to eliminating these problems, and it is therefore an object of the invention to provide a multi-point spark plug capable of facilitating the attachment of a plug cap.

For this purpose, in accordance with an aspect of the present invention, there is a provided a multi-point spark plug comprising a plurality of center electrodes, an insulator for internally accommodating the center electrodes, a housing for holding the insulator, and earth electrodes located at one end portion of the housing and each disposed in opposed relation each of the center electrodes in a state where a discharging gap is interposed therebetween, wherein the insulator includes a head portion protruding from an end surface of the housing opposite to the side in which the earth electrodes exist, a plurality of terminals each to be electrically connected to each of the plurality of center electrodes are provided in the head portion and, in an outside configuration (figuration) composed of the head portion and the terminals, a contour (outline) between a location (site) in which the terminal closest to the housing exists and an end portion remotest from the housing is formed axis-symmetrically with respect to an axis of the head portion.

Thus, since the plurality of terminals are provided on the head portion of the insulator and the contour of the outside configuration composed of the head portion and the terminals is formed axis-symmetrically with respect to the axis of the head portion, in installing the plug cap, there is no need to make the alignment by rotating the plug cap around its axis, which facilitates the connection between the multi-point spark plug and the plug cap. Moreover, even if a plug cap integrally having an ignition coil is installed thereto, it is possible that, after the plug cap is arbitrarily attached to the multi-point spark plug, the fixture can be made through a bolt by rotating the ignition coil portion so that a fitting hole made in the casing of the ignition coil portion aligns with the position of the female screw made in the cylinder head. This facilitates the fixing of the ignition coil portion.

In this case, the "in an outside configuration composed of the head portion and the terminals, a contour between a location at which the terminal closest to the housing exists and an end portion remotest from the housing is formed axis-symmetrically with respect to an axis of the head portion" signifies, for example, that only a contour of an outside configuration composed of the head portion and the terminals has an axial symmetry, and it does not require that the insulator itself and the terminal itself have an axis-symmetrical configuration. Moreover, it does not require that all the contour of the outside configuration composed of the insulator and the terminals are axis-symmetrically formed, but the axis-symmetry of only the contour from a location at which the terminal closest to the housing exists and an end portion remotest from the housing is acceptable. This construction can facilitate the attachment of the plug cap. Still moreover, in this specification, the "axis-symmetry" does not signify a strict geometrical axis-symmetry, but, even if irregularities slightly exist as compared with the ideal geometrical axis-symmetrical shape, the "axis-symmetry" includes it. Therefore, cases equivalent to the present invention in light of the facilitation of the attachment of a plug cap are to be included therein.

In addition, in accordance with another aspect of the present invention, there is provided a multi-point spark plug comprising a plurality of center electrodes, an insulator for internally accommodating the center electrodes, a housing for holding the insulator, and earth electrodes located at one end portion of the housing and each disposed in opposed relation each of the center electrodes in a state where a discharging gap is interposed therebetween, wherein the insulator includes a head portion protruding from an end surface of the housing opposite to the side in which the earth electrodes exist, and a plurality of terminals each to be electrically connected to each of the plurality of center electrodes are provided in an intermediary member attached to the head portion and, in an outside configuration (figuration) composed of the intermediary member and the terminals, a contour (outline) between a location at which the terminal closest to the housing exists and an end portion remotest from the housing is formed axis-symmetrically with respect to an axis of the head portion. This can provide the effects similar to those of the above-mentioned construction.

Still additionally, according to a further aspect of the present invention, the plurality of terminals have a disc-like configuration or a ring-like configuration. Therefore, the electrical connection with the plug cap is securable at any point on the circumference.

Yet additionally, according to a further aspect of the present invention, the plurality of terminals are disposed in a state separated from each other in an axial direction. Therefore, the insulation between the plurality of terminals is easily securable.

Moreover, according to a further aspect of the present invention, the plurality of terminals are made to have a smaller outer diameter as their positions are remoter from the housing. Therefore, the terminal separated from the housing does not hinder the coupling with the plug cap, which achieves the easy connection of the plug cap.

Still moreover, according to a further aspect of the present invention, at least one of the plurality of terminals is constructed with a ring member showing an elastic force to reduce its diameter. Therefore, when, in a state where a force is applied to the ring member to enlarge its diameter, the insulator or the intermediary member is inserted thereinto and the diameter-enlarging force is removed therefrom, the ring member can be fixed by the diameter-reducing elastic force, thus providing easy assembling of the terminals.

Yet moreover, according to a further aspect of the present invention, at least one of the plurality of terminals is placed in a cavity portion made in the insulator or the intermediary member. This prevents the terminal from displacing and dropping out.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS

Embodiments of the present invention will be described hereinbelow with reference to the drawings.

(First Embodiment)

Figure 1:
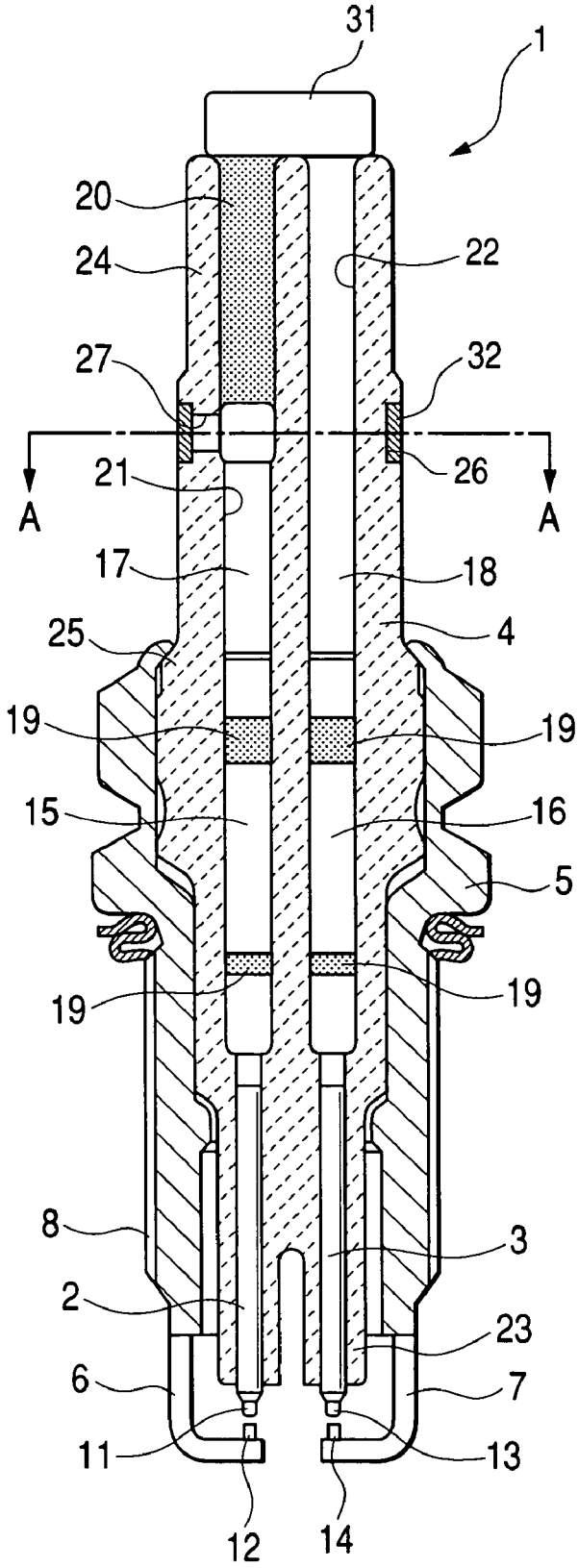
FIG. 1 is a vertical cross-sectional view showing a multi-point spark plug according to a first embodiment of the present invention.
Figure 2:
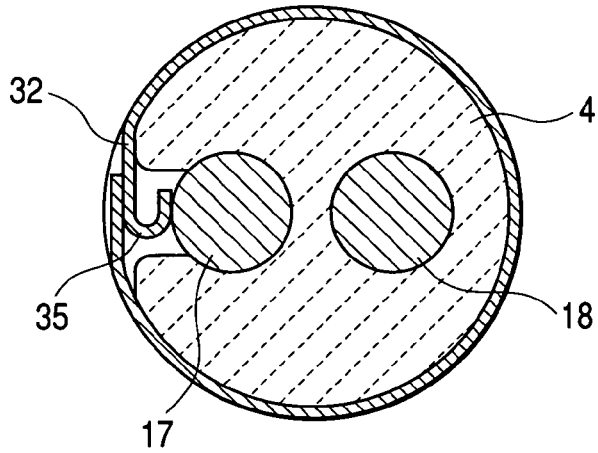
FIG. 2 is a horizontal cross-sectional view showing the multi-point spark plug of FIG. 1, and taken along a line A—A therein.

FIG. 1 is a vertical cross-sectional view showing a multi-point spark plug according to a first embodiment of the present invention, and FIG. 2 is a horizontal cross-sectional view showing the multi-point spark plug of FIG. 1, and taken along a line A—A therein.

The multi-point spark plug, generally designated at reference numeral 1, is made up of a pair of center electrodes 2 and 3, an insulator 4 internally accommodating the center electrodes 2 and 3, a housing 5 for holding the insulator 4 and earth electrodes 6 and 7 located at one end portion of the housing 5 and each disposed in confronting relation to each of the center electrodes 2 and 3 in a state where a discharging gap is interposed therebetween.

Each of the center electrodes 2 and 3 is made of a metallic material, such as an Ni-base alloy, having a high heat resistance and a high corrosion resistance, and has a cylindrical configuration. A tip surface thereof confronting the corresponding earth electrode 6, 7 has a convergent (tapered) configuration, and a chip 11, 13, made of a noble metal or an alloy containing it is joined thereto through laser welding.

The insulator 4 is made of alumina ceramics, and it is composed of a fork-like leg portion 23 protruding from one side of the housing 5, where the earth electrodes 6 and 7 exist, and a generally cylindrical head portion 24 protruding from an end surface of the other side thereof opposite to the side of the existence of the earth electrodes 6 and 7.

In the interior of the insulator 4, a pair of axial holes 21 and 22 are made and, in the order from the leg portion 23 toward the head portion 24, there are disposed the pair of center electrodes 2 and 3, a pair of resistors 15 an 16, and stems 17 and 18. On both end portions of the resistors 15 and 16, there are placed a plurality of copper glass layers 19.

The upper end surface of the stem 18 is positioned in the same plane as the upper end surface of the insulator 4, and a disc-like first terminal 31 made from an SCM material is joined with the upper end surface of the stem 18. The overall length of the stem 17 is approximately half the overall length of the stem 18, and an insulating material 20 is interposed between the stem 17 and the first terminal 31.

A circumferential groove 26 is formed in an outer circumferential surface of the head portion 24, and a through hole 27 is made to extend from a bottom surface of the circumferential groove 26 to the axial hole 21. In this circumferential groove 26, there is fitted a ring-like second terminal 32 having a cross section shown in FIG. 2. The second terminal 32 is made by machining a plate material made of phosphor bronze or stainless steel, and it has a diameter smaller than the diameter of the circumferential groove 26 in a state where an external force is not applied thereto and, in a state placed in the circumferential groove 26, it shows an elastic force so that its diameter reduces. A contact piece 35 bent into a U-like configuration is formed at an end portion of the second terminal 32. This contact piece 35 is positioned in the interior of the through hole 27 to come into contact with the stem 17.

The second terminal 32 is located at an approximately intermediate position between the first terminal 31 and the head portion 24 side end surface of the housing 5, and the insulation of the second terminal 32 is secured with respect to the first terminal 31 and the housing 5. Moreover, the first terminal 31 disposed more remotely than the second terminal 32 with respect to the housing 5 has an outer diameter smaller than that of the second terminal 32 so as not to hinder the engagement with the plug cap.

The housing 5 includes the pair of earth (ground) electrodes 6 and 7 each formed into an L-like configuration and fixed through welding to one end surface thereof. These earth electrodes 6 and 7 are made of an Ni-base alloy, and chips 12 and 14 made of a noble metal or an alloy containing it are joined through welding with the tip side surfaces thereof, respectively. The chips 12 and 14 welded to the earth electrodes 6 and 7 are placed in opposed relation to chips 11 and 13 welded to the center electrodes 2 and 3, respectively, in a state where a discharging gap is interposed therebetween. a male screw 8 is formed in an outer circumferential surface of the housing 5 to engage with a female screw formed in a cylinder head (not shown).

Figure 3:
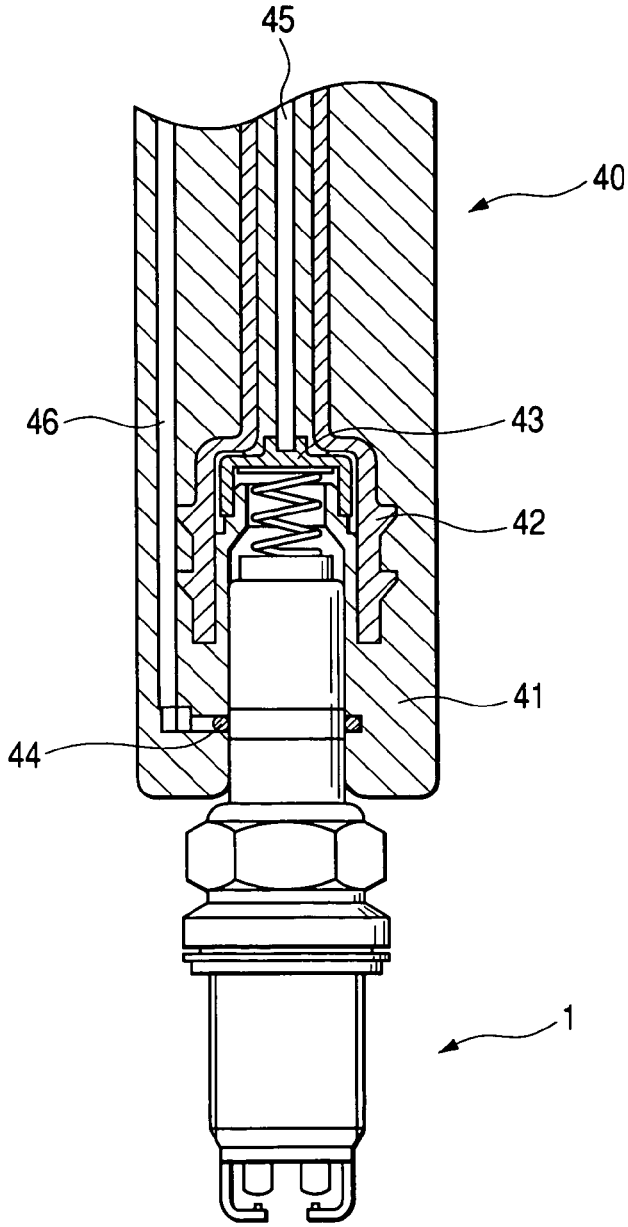
FIG. 3 is an illustration of connection between the multi-point spark plug shown in FIG. 1 and a plug cap.

Secondly, a description will be given hereinbelow of the effects of this embodiment. FIG. 3 is an illustration of the connection between the multi-point spark plug 1 and a plug cap 40.

In the interior of a cap portion 41 made of a silicone rubber, there are disposed a core material 42 made of a thermoplastic resin, a first contact terminal 43 including a bowl-like member made of an aluminum alloy and a spring placed on a bottom surface thereof, a ring-like second contact terminal 41 made of an aluminum alloy, and lead wires 45 and 46 electrically connected to the first and second contact terminals 43 and 44, respectively. This plug cap 40 is formed by the insert molding.

In the multi-point spark plug 1 according to this embodiment, the first terminal 31 and the second terminal 32 are provided at the head portion 24 of the insulator 4, and in an outside configuration (figuration) made by the head portion 24, the first terminal 31 and the second terminal 32, a contour (outline) between a location (site) at which the second terminal 32 closest to the housing 5 exists and the first terminal 31 forming an end portion remotest from the housing 5 is formed axis-symmetrically with respect to the axis of the head portion 24. Therefore, in attaching the plug cap 40 thereto, there is no need to rotate the plug cap 40 around its axis for the alignment and, hence, the easy connection between the multi-point spark plug 1 and the plug cap 40 becomes feasible. Moreover, even in the case of the installation of a plug cap integrally having an ignition coil portion, after the plug cap is arbitrarily set to the multi-point spark plug 1, the fixture can be made through the use of a bolt in a manner such that the ignition coil portion is rotated so that a fitting hole made in a casing of the ignition coil portion aligns with the position of a female screw formed in a cylinder head, thereby enabling the ignition coil portion to be fixedly secured to the cylinder head.

As described above, the first contact terminal 43 and the first terminal 31 are brought into contact with each other and the second contact terminal 44 and the second terminal 32 are brought into contact with each other and, hence, the multi-point spark plug 1, to which the plug cap 40 is attached, can supply voltages to the center electrodes 2 and 3. In response to the voltage application to the center electrodes 2 and 3, the spark discharge takes place between the chips 11 and 12 and between the chips 13 and 14 to ignite the air-fuel mixture in the combustion chamber.

(Second Embodiment)

Figure 4:
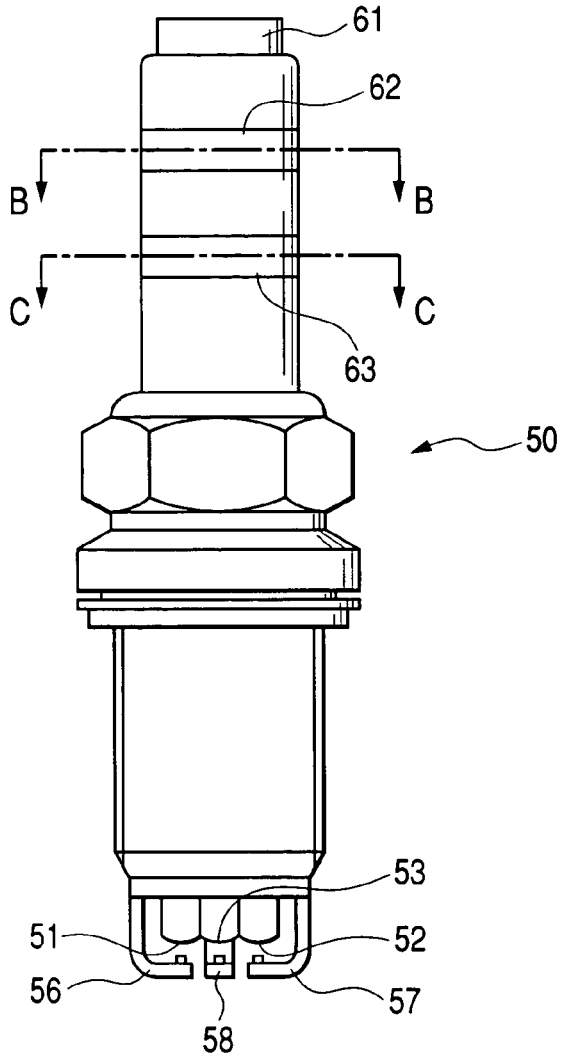
FIG. 4 is a front view showing a multi-point spark plug according to a second embodiment of the present invention.
Figure 5:
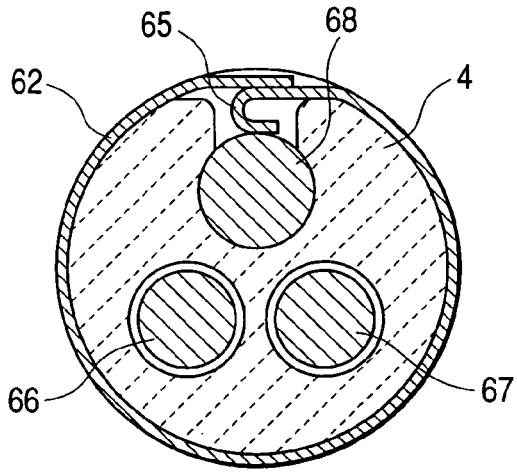
FIG. 5 is a horizontal cross-sectional view showing the multi-point spark plug of FIG. 4, and taken along a line B—B therein.
Figure 6:
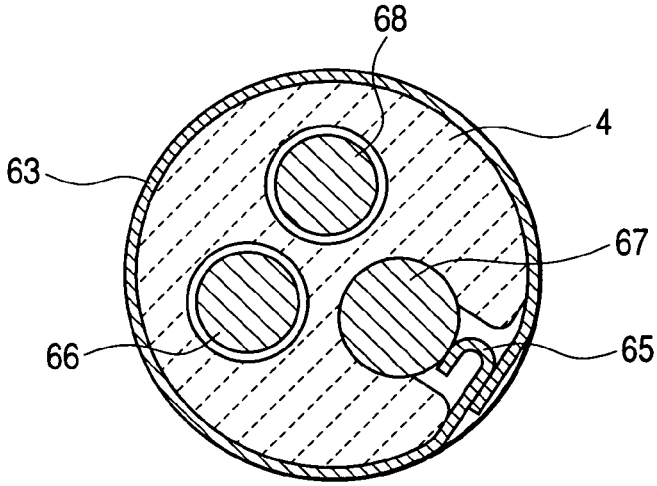
FIG. 6 is a horizontal cross-sectional view showing the multi-point spark plug of FIG. 5, and taken along a line C—C therein.

FIG. 4 is a front view showing a multi-point spark plug 50 according to a second embodiment of the present invention, FIG. 5 is a horizontal cross-sectional illustration of the multi-point spark plug 50 taken along a line B—B of FIG. 4, and FIG. 6 is a horizontal cross-sectional illustration of the multi-point spark plug 50 taken along a line C—C of FIG. 4.

A difference from the first embodiment shown in FIGS. 1 and 2 is only that the multi-point spark plug 50 is equipped with three center electrodes 51, 52 and 53, three earth electrodes 56, 57 and 58, and a first terminal 61, a second terminal 62 and a third terminal 63 electrically connected to the center electrodes 51, 52 and 53, respectively. Detailed description of the other members will be omitted for brevity.

The first terminal 61 has a disc-like configuration and is joined with a stem 66 electrically connected to the center electrode 51. The second terminal 62 has a ring-like configuration having a cross section shown in FIG. 5 and has, at its end portion, a contact piece 65 bent into a U-like configuration. This contact piece 65 is brought into contact with a stem 68 electrically connected to the center electrode 53, thereby securing the electrical connection between the second terminal 62 and the center electrode 53. The third terminal 63 has a ring-like configuration shown in FIG. 6 and has, at its end portion, a contact piece 65 bent into a U-like configuration. This contact piece 65 is brought into contact with a stem 67 electrically connected to the center electrode 52, thereby securing the electrical connection between the third terminal 63 and the center electrode 52.

The multi-point spark plug 50 according to this embodiment is a multi-point spark plug capable of three-point ignition and facilitates the attachment of a plug cap as well as the first embodiment.

(Third Embodiment)

Figure 7:
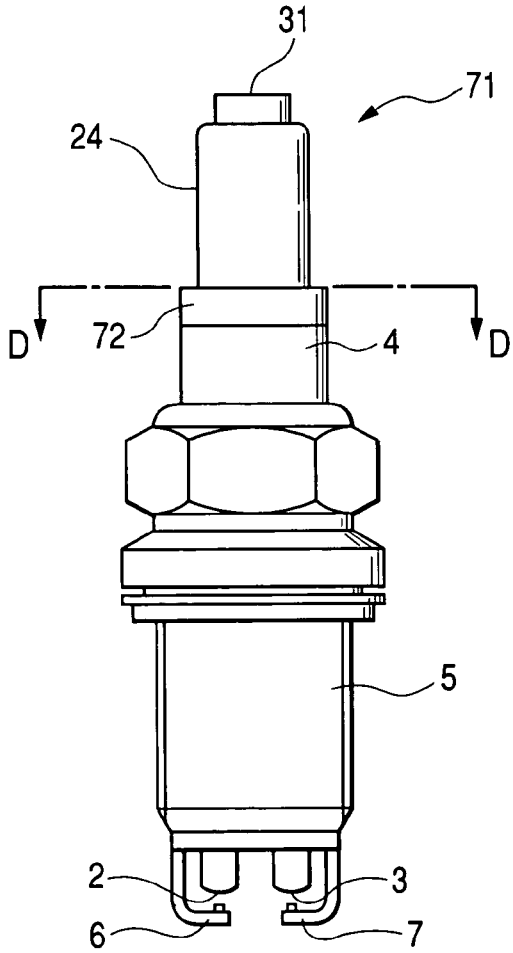
FIG. 7 is a vertical cross-sectional view showing a multi-point spark plug according to a third embodiment of the present invention.
Figure 8:
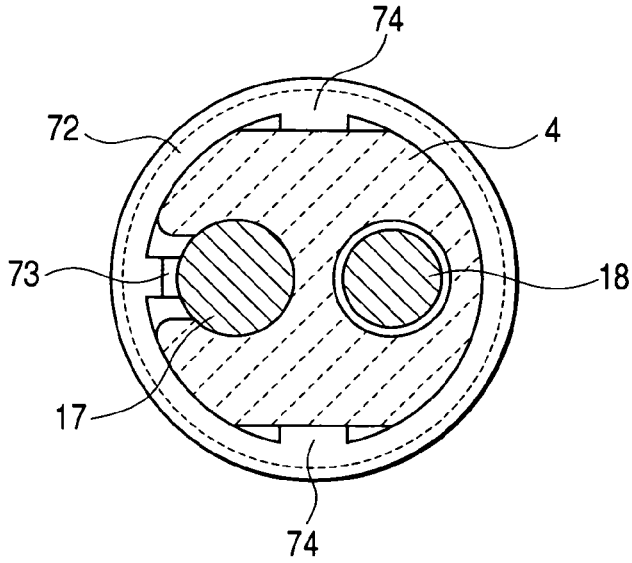
FIG. 8 is a horizontal cross-sectional view showing the multi-point spark plug of FIG. 7, and taken along a line D—D therein.
Figure 9:
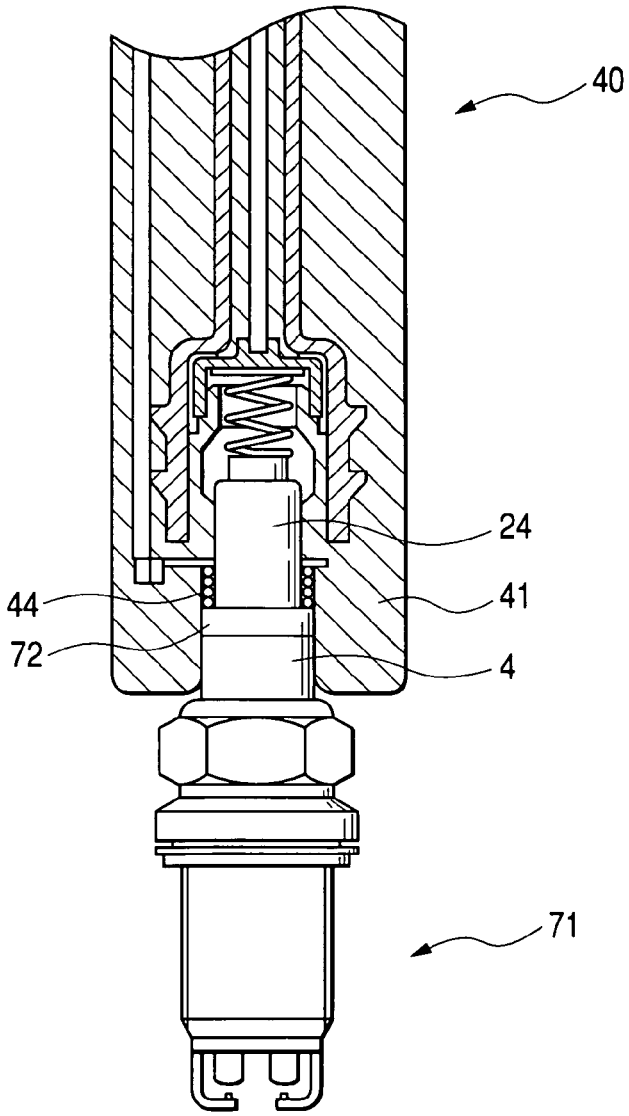
FIG. 9 is an illustration of connection between the multi-point spark plug shown in FIG. 7 and a plug cap.

FIG. 7 is a front view showing a multi-point spark plug 71 according to a third embodiment of the present invention, FIG. 8 is a horizontal cross-sectional illustration of the multi-point spark plug 71 taken along a line D—D, and FIG. 9 is a partial cross-sectional view showing the joining of the multi-point spark plug 71 and a plug cap 40.

A difference from the first embodiment shown in FIGS. 1 and 2 is only a construction of a second terminal 72 and a construction of an insulator 4 in the vicinity of the second terminal 72. A detailed description of the other components is omitted for simplicity.

The second terminal 72 is formed by means of the drawing and formed into a ring-like configuration having a cylindrical surface and an upper end surface as shown in FIGS. 7 and 8. In the inner circumference of the second terminal 72, there are provided a conducting contact piece 73 formed by bending a claw portion made to protrude toward the inner-diameter side of the upper end surface and two holding pieces 74. These two holding pieces 74 are provided at positions shifted by 90 degrees in opposite directions with respect to the position of the conducting contact piece 73 to be in opposed relation to each other.

A step portion is formed at a central portion of a head portion of an insulator 4 in its axial direction so that the second terminal 72 is put thereon. In the location of the disposition of the second terminal of the insulator 4, a chamfer is formed at a position confronting each of the holding pieces 74, and a through hole extending from an outer surface of the insulator 4 to an axial hole in which a stem 17 exists is made at a position confronting the conducting contact piece 73.

The holding pieces 74 of the second terminal 72 are brought into elastic contact with the chamfered portions to prevent the displacement of the second terminal 72 by means of the elastic force thereof. Moreover, the conducting contact piece 73 is brought into elastic contact with the stem 17 through the through hole, thereby achieving the electrical connection (conduction).

In the multi-point spark plug 71, since the second terminal 72 has the upper end surface, the electrical connection with a plug cap 40 is securable through this upper end surface. Therefore, when, as shown in FIG. 9, the plug cap 40 equipped with a second contact terminal 44 comprising a spring expanding and contracting in a cap portion 41 is attached to the multi-point spark plug 71, a lower end surface of the second contact terminal 44 comes into elastic contact with the upper end surface of the second terminal 72, thus effecting the electrical connection therebetween.

In the multi-point spark plug 71 according to this embodiment, in an outside configuration comprising the head portion 24, the first terminal 31 and the second terminal 72, the contour between the location of the second terminal 72 closest to the housing 5 and the first terminal 31 forming an end portion remotest from the housing 5 is formed axis-symmetrically with respect to the axis of the head portion 24, thus providing easy attachment of the plug cap as in the case of the first embodiment.

(Fourth Embodiment)

Figure 10:
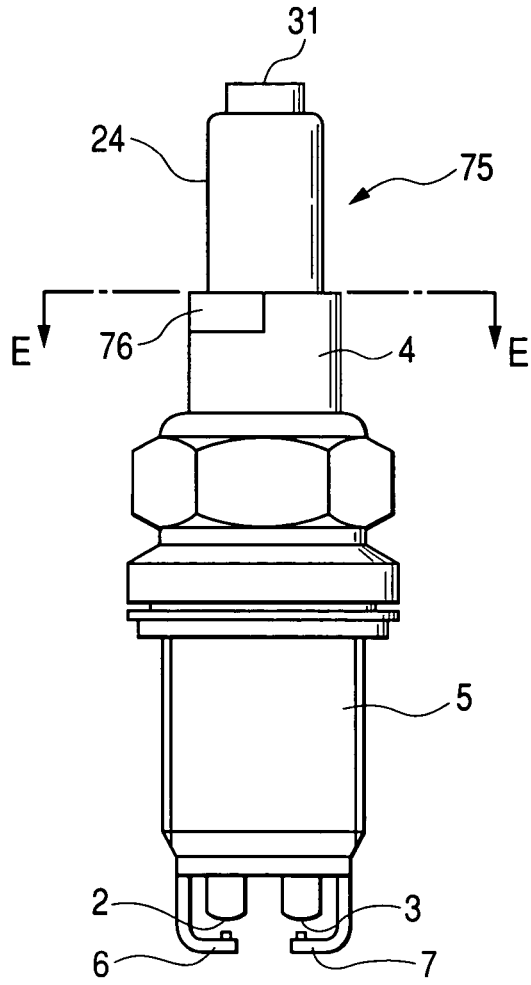
FIG. 10 is a vertical cross-sectional view showing a multi-point spark plug according to a fourth embodiment of the present invention.
Figure 11:
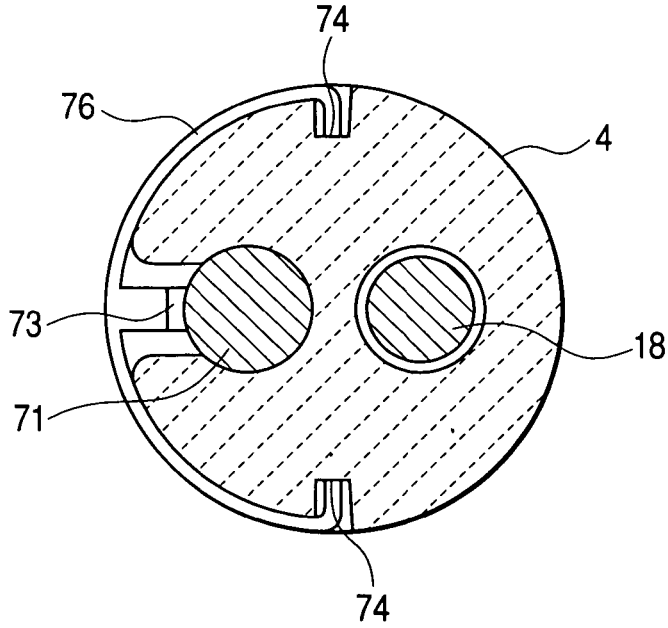
FIG. 11 is a horizontal cross-sectional view showing the multi-point spark plug of FIG. 10, and taken along a line E—E therein.
Figure 12:
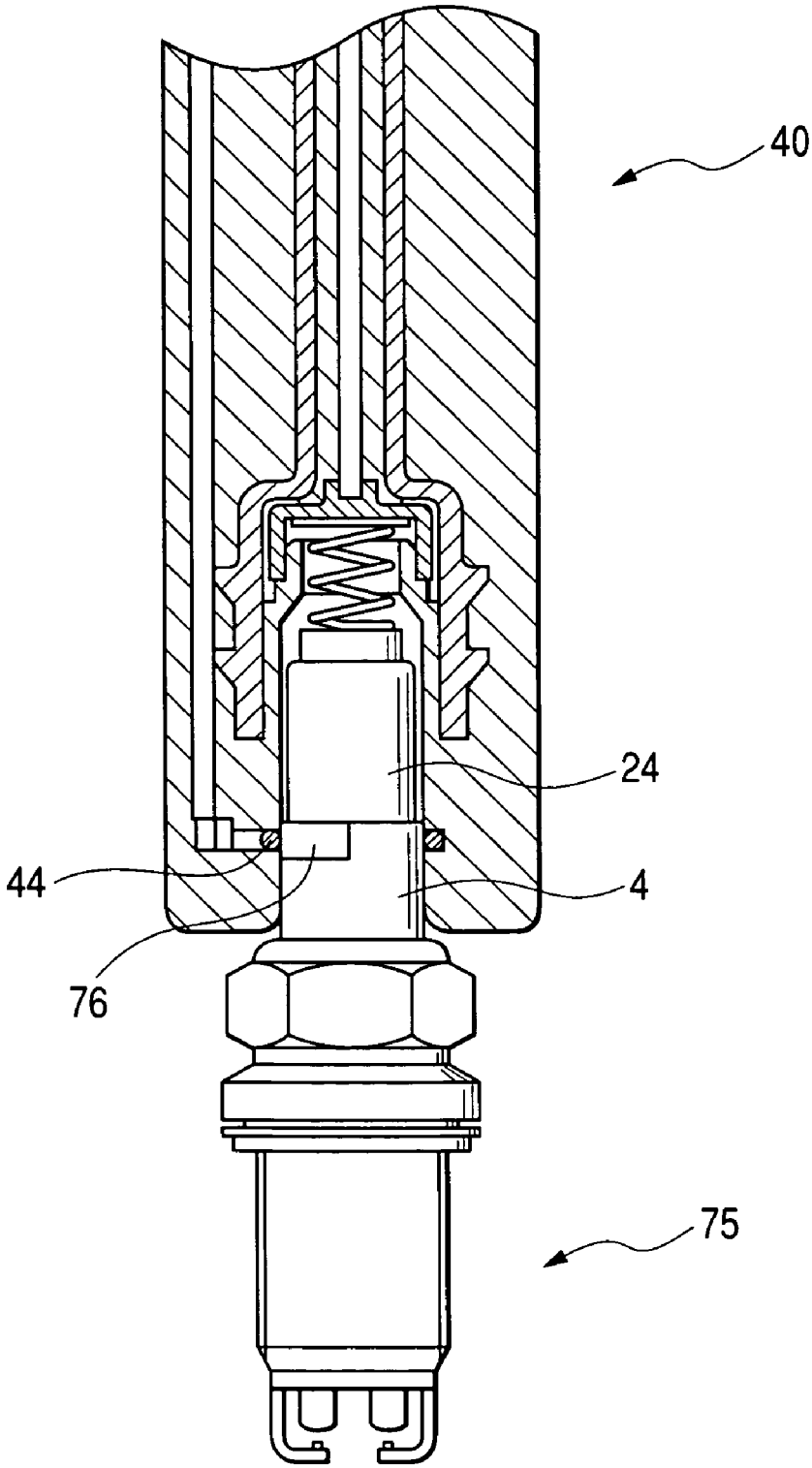
FIG. 12 is an illustration of connection between the multi-point spark plug shown in FIG. 10 and a plug cap.

FIG. 10 is a front view showing a multi-point spark plug 75 according to a fourth embodiment of the present invention, FIG. 11 is a horizontal cross-sectional illustration of the multi-point spark plug 75 taken along a line E—E of FIG. 10, and FIG. 12 is a partial cross-sectional view showing the attachment of the multi-point spark plug 75 and a plug cap 40.

A different point from the first embodiment shown in FIGS. 1 and 2 is only a construction of a second terminal 76 and a construction of an insulator 4 in the vicinity of the second terminal 76. A detailed description of the other components is omitted for simplicity.

The second terminal 76 is formed by means of the drawing and has a semicircular (semi-cylindrical) configuration as shown in FIG. 11. A conducting contact piece 73 formed by bending a claw portion made to protrude toward the inner-diameter side is provided at a central portion of the second terminal 76 in its circumferential direction. Moreover, at both circumferential end portions of the second terminal 76, there are provided holding pieces 74 formed by bending the end portions.

A cavity portion is made at a central portion of a head portion of an insulator 4 in its axial direction so that the second terminal 76 is put thereon. Engaging (fitting) holes are made at positions confronting the holding pieces 74 in the location of the disposition of the second terminal 76 of the insulator 4, and a through hole extending from an outer surface of the insulator 4 to an axial hole in which a stem 17 exists is made at a position confronting the conducting contact piece 73.

The second terminal 76 has an elastic force to reduce its diameter, and the holding pieces 74 engage with the engaging holes, thereby preventing the displacement of the second terminal 76. Moreover, the conducting contact piece 73 comes into elastic contact with the stem 17 through the through hole, thereby securing the electrical connection therewith.

The second terminal 76 has the semicircular configuration and, hence, does not have an axis-symmetrical configuration. However, in the multi-point spark plug 75 according to this embodiment, since, in the outside configuration made by the head portion 24, the first terminal 31 and the second terminal 76, the contour between the location of the second terminal 76 closest to the housing 5 and the first terminal 31 forming an end portion remotest from the housing 5 is formed axis-symmetrically with respect to the axis of the head portion 24, the easy attachment of the plug cap becomes easy as in the case of the first embodiment.

In addition, the second terminal 76 has the semicircular configuration and, hence, only an area corresponding to the half of the circumference contributes to the electrical connection with the plug cap 40. However, as shown in FIG. 12, when the plug cap 40 having a ring-like second contact terminal 44 is attached thereto, the electrical connection between the multi-point spark plug 75 and the plug cap 40 is securable without rotating the plug cap 40 around its axis for the alignment.

(Fifth Embodiment)

Figure 13:
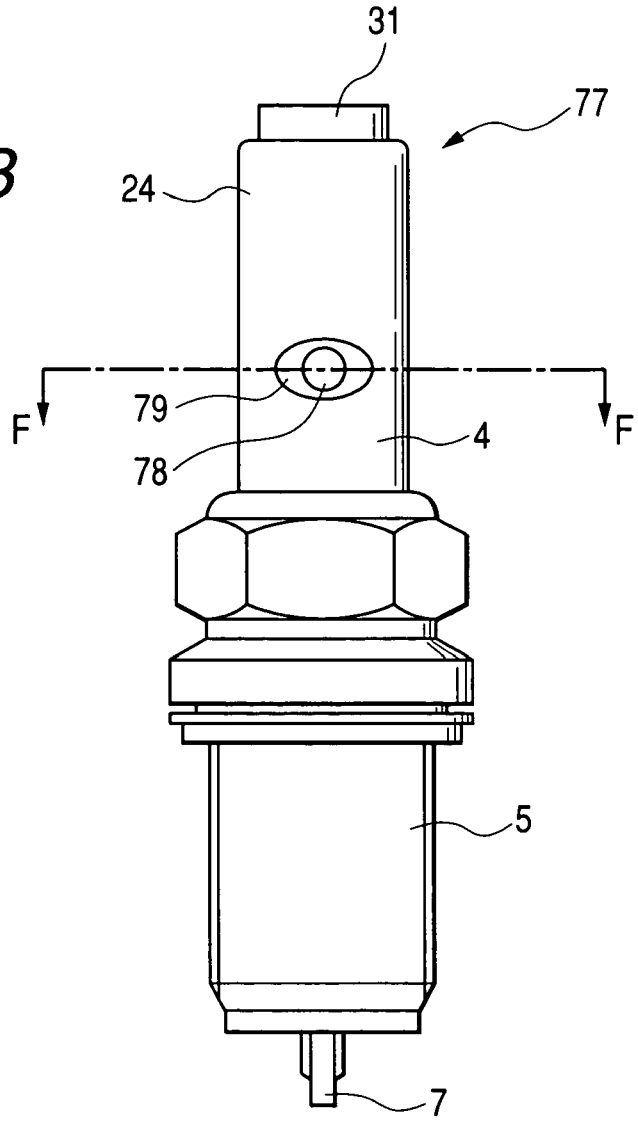
FIG. 13 is a vertical cross-sectional view showing a multi-point spark plug according to a fifth embodiment of the present invention.
Figure 14:
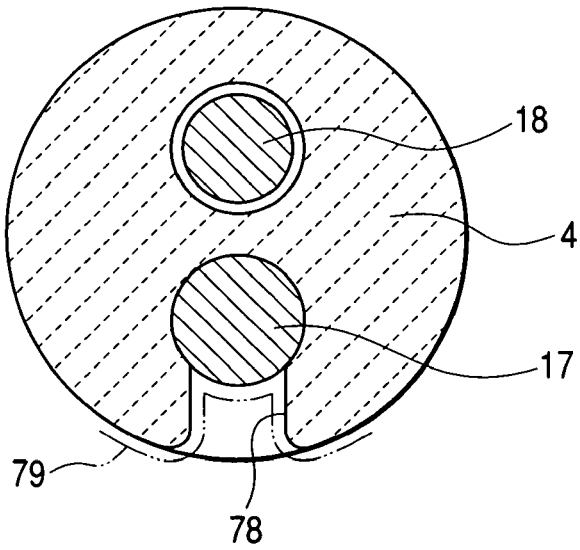
FIG. 14 is a horizontal cross-sectional view showing the multi-point spark plug of FIG. 13, and taken along a line E—E therein.
Figure 15:
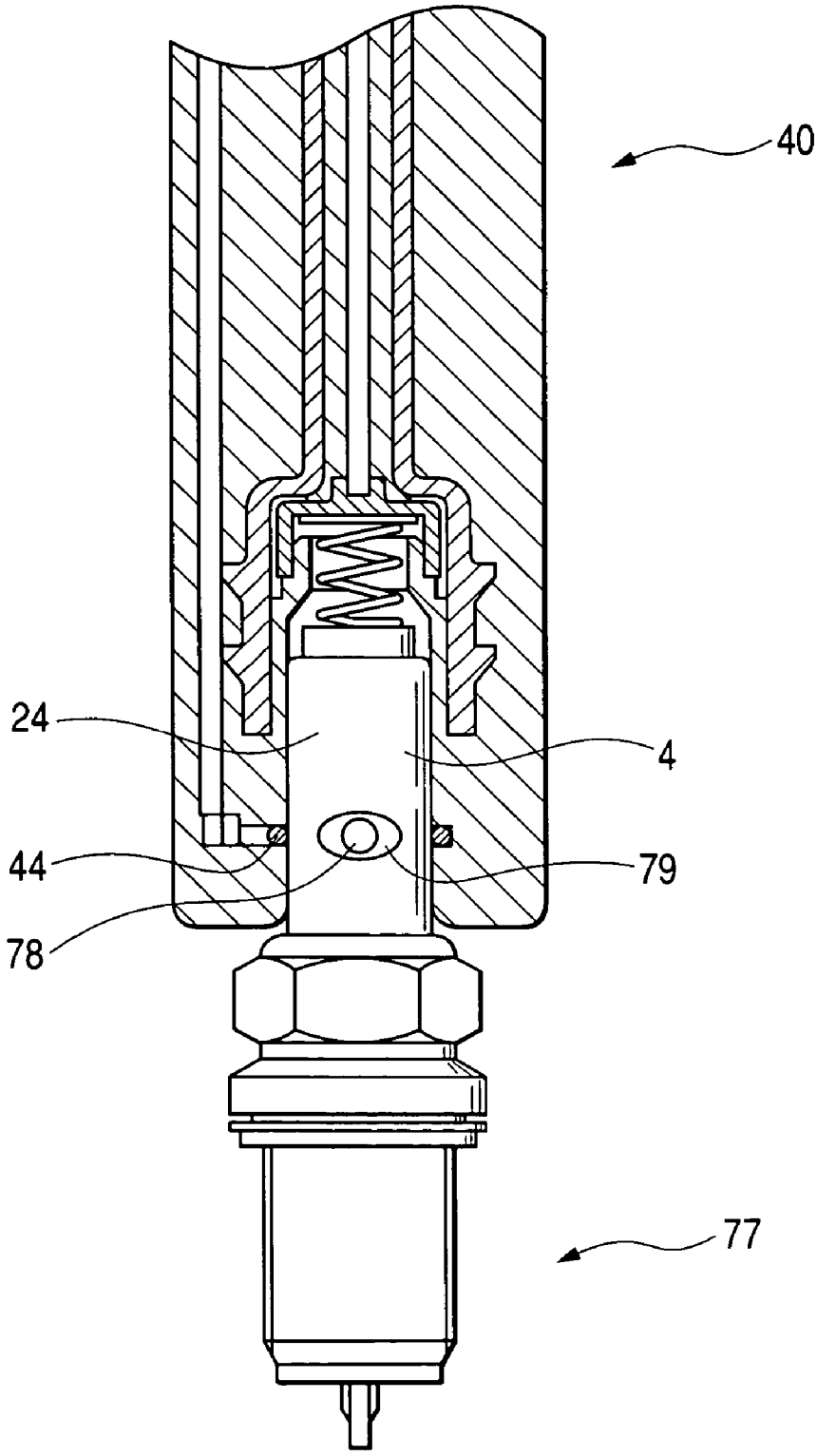
FIG. 15 is an illustration of connection between the multi-point spark plug shown in FIG. 13 and a plug cap.

FIG. 13 is a side view showing a multi-point spark plug 77 according to a fifth embodiment of the present invention, FIG. 14 is a horizontal cross-sectional illustration of the multi-point spark plug 77 taken along a line F—F of FIG. 13, and FIG. 15 is a partial cross-sectional view showing the attachment of the multi-point spark plug 77 and a plug cap 40.

A different point from the first embodiment shown in FIGS. 1 and 2 is only that a second terminal is formed integrally with an insulator 4. A detailed description of the other components is omitted for simplicity.

At a central portion of a head portion of the insulator 4, there is formed a through hole 78 which extends from an outer surface of an insulator 4 to an axial hole in which a stem 17 exists. Moreover, an electrically conductive metallized film is formed at a portion in the vicinity of a circumferential edge of the through hole 78, an inner circumferential surface of the through hole 78 and a portion confronting the through hole 78 (sites indicated by a two-dot chain line in FIG. 14). This metallized film constitutes a second terminal 79. This second terminal 79 can be made according to the well-known metallizing technique to be used for the joining of ceramics and metal.

The multi-point spark plug 77 according to this embodiment has the through hole 78 at axial central portion of the head portion 24 of the insulator 4 and, strictly speaking, a contour of an outside configuration made with the head portion and the terminals does not have a geometric axis-symmetrical configuration. However, even if the through hole 78 exists, it does not hinder the attachment of the plug cap 40. Therefore, the multi-point spark plug 77 can provide the effects of the attachment of the plug cap 40 being made easy.

Accordingly, it is possible to interpret the multi-point spark plug 77 as the contour of the outside configuration made by the head portion 24, the first terminal 31 and the second terminal 79 has an axis-symmetrical configuration.

(Sixth Embodiment)

Figure 16:
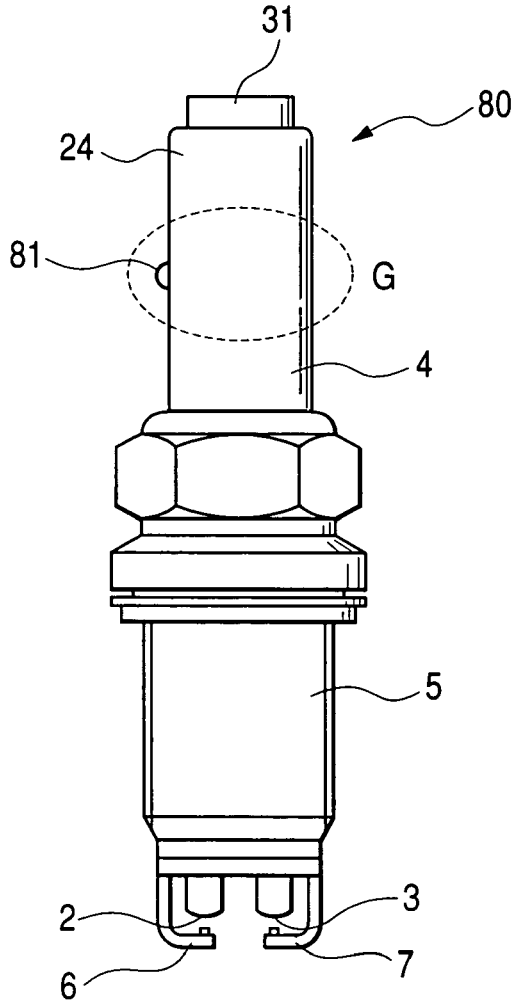
FIG. 16 is a vertical cross-sectional view showing a multi-point spark plug according to a sixth embodiment of the present invention.
Figure 17:
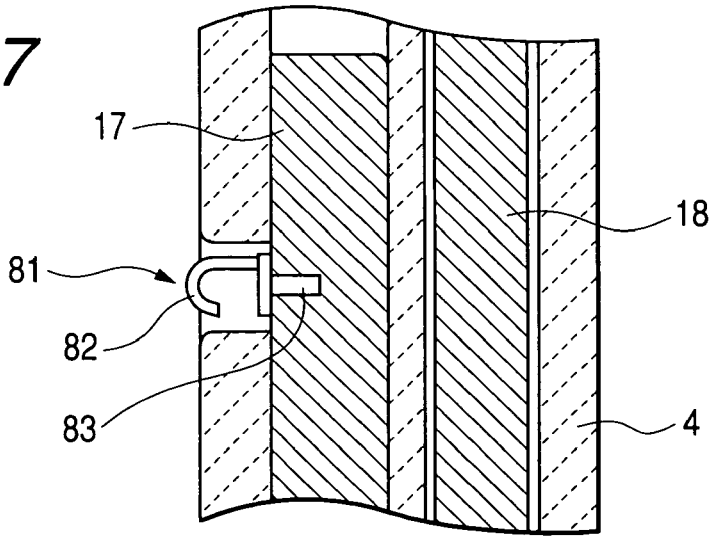
FIG. 17 is an enlarged cross-sectional view showing a portion, indicated by G, in the multi-point spark plug shown in FIG. 16
Figure 18:
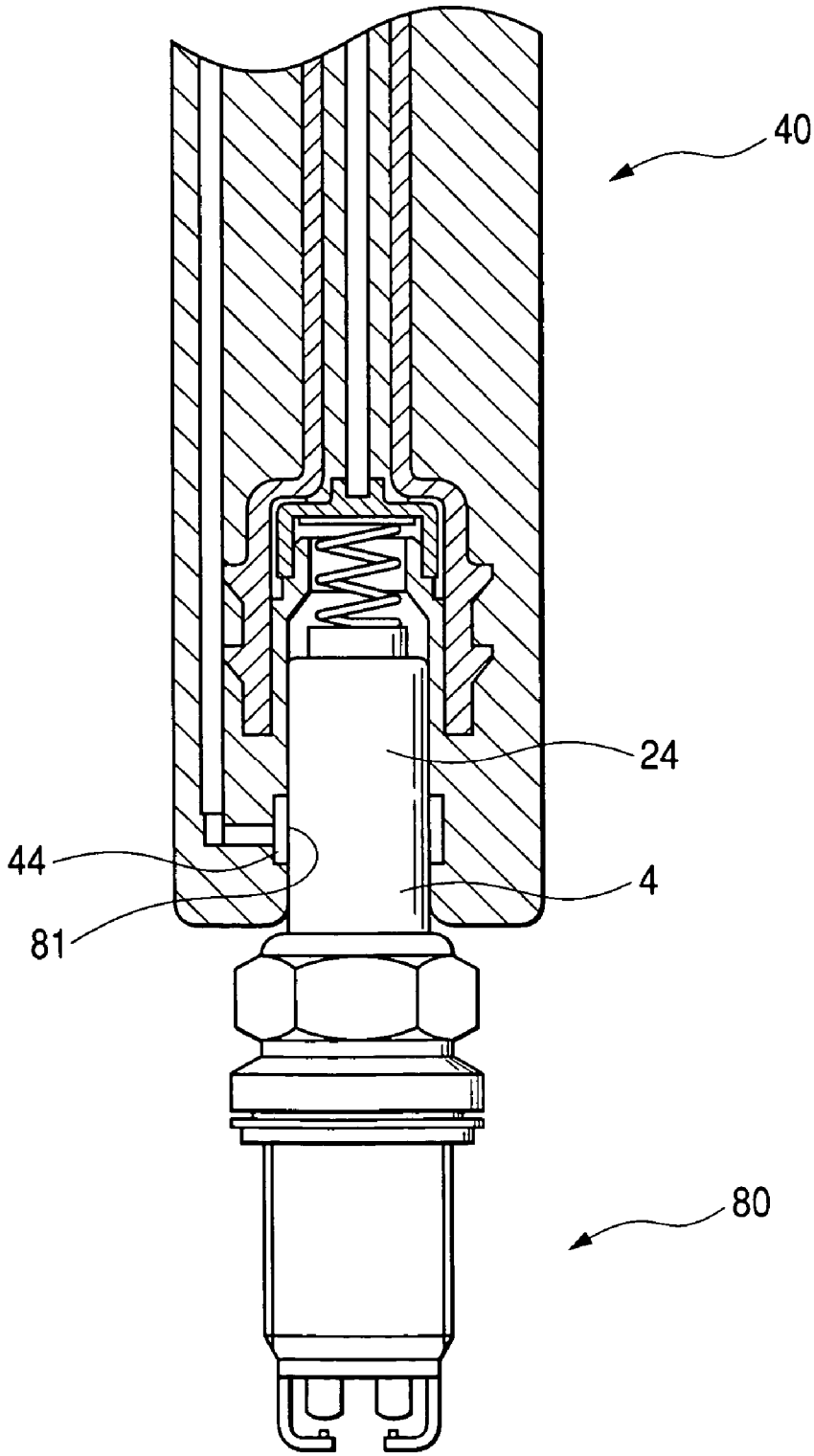
FIG. 18 is an illustration of connection between the multi-point spark plug shown in FIG. 16 and a plug cap.

FIG. 16 is a front view showing a multi-point spark plug 80 according to a sixth embodiment of the present invention, FIG. 17 is an enlarged cross-sectional view showing a portion, indicated by character G, in the multi-point spark plug 80, and FIG. 18 is an illustration of the connection between the multi-point spark plug 80 and a plug cap 40.

A difference from the first embodiment shown in FIGS. 1 and 2 is only a construction of a second terminal 81 and a construction of an insulator 4 in the vicinity of the second terminal 81. A detailed description of the other components is omitted for simplicity.

At a central portion of a head portion of the insulator 4, there is formed a through hole which extends from an outer surface of the insulator 4 to an axial hole in which a stem 17 exists. Moreover, the through hole accommodates a second terminal 81 including a semicircular conducting contact piece 82 positioned on an outer surface side of the insulator 4 and a seating 83 positioned on a back side of the insulator 4. The second terminal 81 is welded so that the seating 83 is embedded in a fixing hole made in the stem 17.

In the multi-point spark plug 80 according to this embodiment, the second terminal 81 protrudes from an outer surface of the insulator 4 and, hence, the contour of the outside configuration does not have a strictly geometric axis-symmetrical configuration. However, the conducting contact piece 82 of the second terminal 81 is supported to be elastically deformable so that, at the attachment of the plug cap 40, the conducting contact piece 82 can be pushed in the back side of the insulator 4. Therefore, it does not obstruct the attachment of the plug cap 40 and, hence, the multi-point spark plug 80 can provide the effects of the present invention which facilitate the attachment of the plug cap 40.

For this reason, it is possible to interpret the multi-point spark plug 80 as the contour of the outside configuration made by the head portion 24, the first terminal 31 and the second terminal 81 is formed into an axis-symmetrical configuration.

(Seventh Embodiment)

Figure 19:
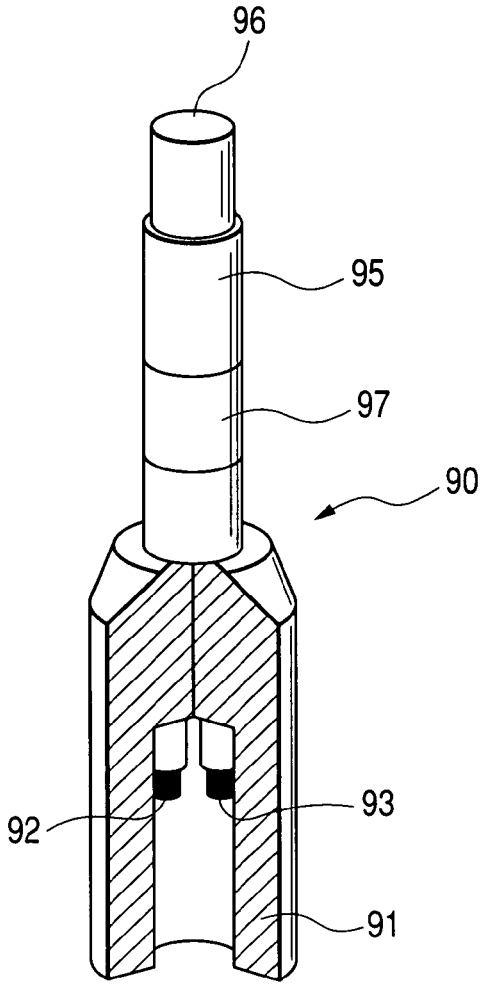
FIG. 19 is a partial cross-sectional perspective view showing an intermediary member constituting a multi-point spark plug according to a seventh embodiment of the present invention.
Figure 20:
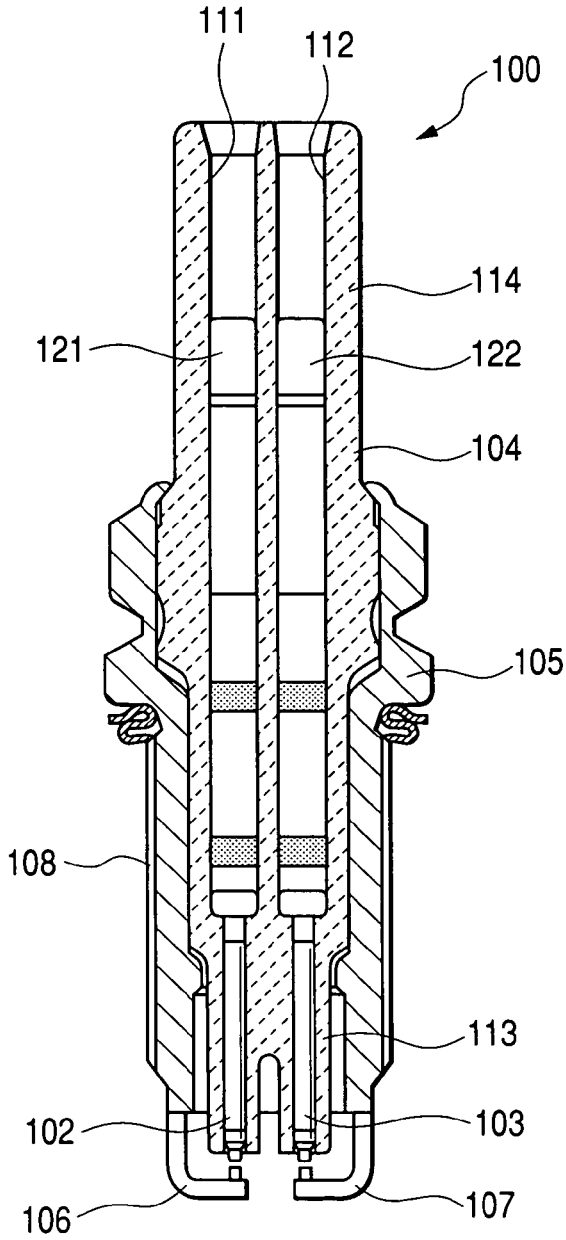
FIG. 20 is a vertical cross-sectional view showing a multi-point spark plug according to a comparative example.
Figure 21:
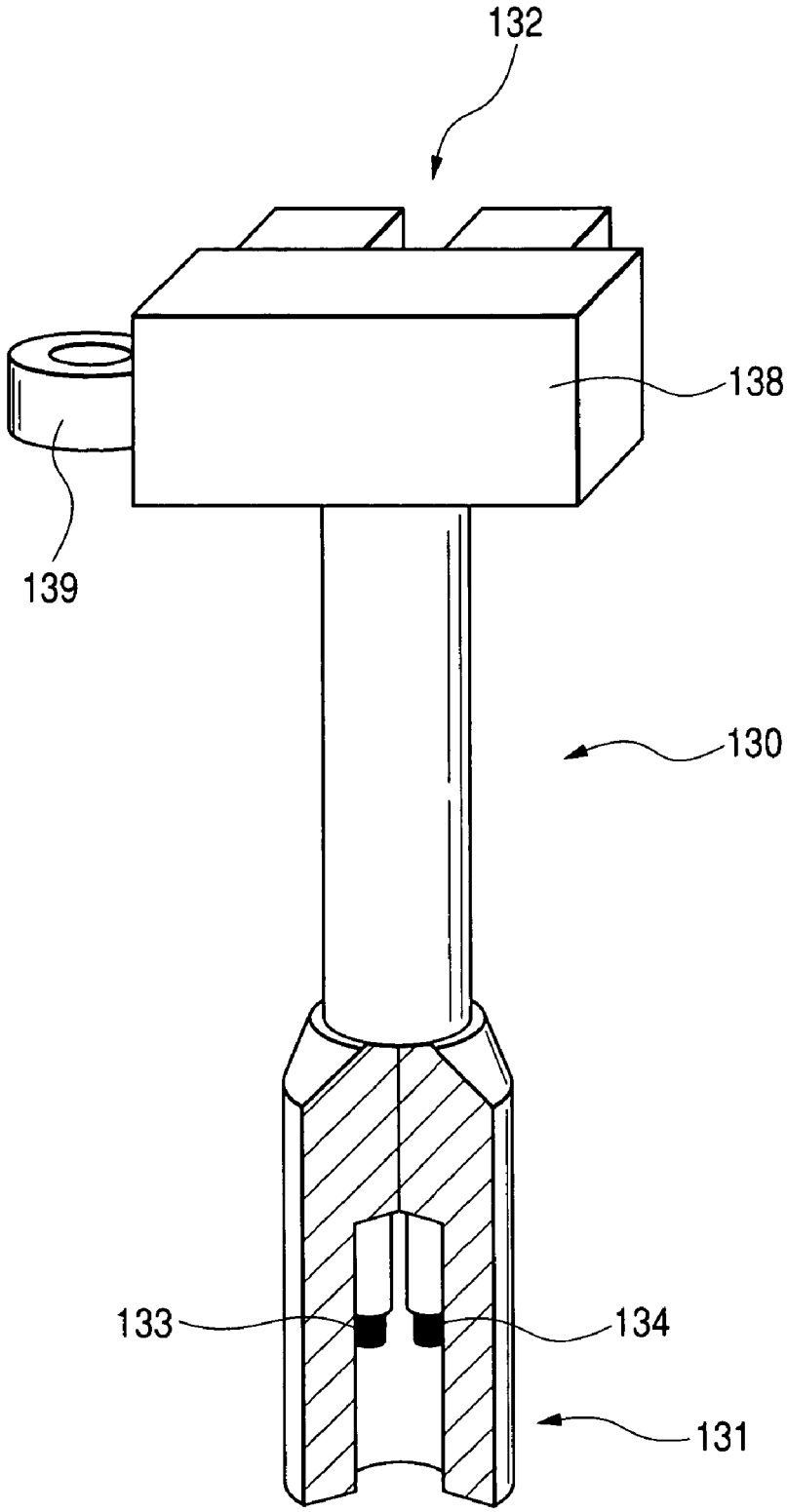
FIG. 21 is a partial cross-sectional perspective view showing a plug cap to be connected to the multi-point spark plug according to the comparative example.

FIG. 19 is a partial cross-sectional perspective view showing an intermediary member 90 constituting a multi-point spark plug according to a seventh embodiment of the present invention. The seventh embodiment relates to a multi-point spark plug comprising a combination of the intermediary member 90 and the multi-point spark plug 100 shown in FIG. 20.

The intermediary member 90 is made of a silicone rubber and is composed of a blind-end cylindrical cap portion 91 which is made to cover a head portion 114 of the multi-point spark plug 100 and a proximal (base) portion 95 made of a thermoplastic resin and having a generally column-like (cylindrical) configuration. A first contact terminal 92 and a second contact terminal 93, each of which comprises a bar-like proximal portion and a spring provided on tip surface of the bar-like proximal portion, protrude from a bottom surface of the cap portion 91. On an outer surface of the proximal portion 95, a third terminal 96 and a fourth terminal 97 are provided which are electrically connected to the first contact terminal 92 and the second contact terminal 93, respectively. The intermediary member 90 is attached to the multi-point spark plug 100 so that the first contact terminal 92 and the second contact terminal 93 are brought into contact with a first terminal 121 and a second terminal 122 in the multi-point spark plug 100.

The combination of the intermediary member 90 and the multi-point spark plug 100 made in this way also can facilitate the attachment of the plug cap as in the case of the first embodiment.

It should be understood that the present invention is not limited to the above-described embodiments, and that it is intended to cover all changes and modifications of the embodiments of the invention herein which do not constitute departures from the spirit and scope of the invention.

What is claimed is:

1. A multi-point spark plug comprising:

a plurality of center electrodes;

an insulator for accommodating said center electrodes;

a housing for holding said insulator; and earth electrodes located at one end portion of said housing and each disposed in opposed relation each of said center electrodes in a state where a discharging gap is interposed therebetween, wherein said insulator includes a head portion protruding from an end surface of said housing opposite to the side in which said earth electrodes exist, and a plurality of terminals each to be electrically connected to each of said plurality of center electrodes are provided in said head portion, and, in an outside configuration composed of said head portion and said terminals, a contour between a location in which the terminal closest to said housing exists and an end portion remotest from said housing is formed axis-symmetrically with respect to an axis of the head portion.

2. A multi-point spark plug comprising:

a plurality of center electrodes;

an insulator for accommodating said center electrodes;

a housing for holding said insulator; and earth electrodes located at one end portion of said housing and each disposed in opposed relation each of said center electrodes in a state where a discharging gap is interposed therebetween, wherein said insulator includes a head portion protruding from an end surface of said housing opposite to the side in which said earth electrodes exist, and a plurality of terminals each to be electrically connected to each of said plurality of center electrodes are provided in an intermediary member attached to said head portion and, in an outside configuration composed of said intermediary member and said terminals, a contour between a location in which the terminal closest to said housing exists and an end portion remotest from said housing is formed axis-symmetrically with respect to an axis of said head portion.

3. The plug according to claim 1, wherein said plurality of terminals have a disc-like configuration or a ring-like configuration.

4. The plug according to claim 2, wherein said plurality of terminals have a disc-like configuration or a ring-like configuration.

5. The plug according to claim 1, wherein said plurality of terminals are disposed in a state separated from each other in an axial direction.

6. The plug according to claim 2, wherein said plurality of terminals are disposed in a state separated from each other in an axial direction.

7. The plug according to claim 5, wherein said plurality of terminals are made to have a smaller outer diameter as their positions are remoter from said housing.

8. The plug according to claim 6, wherein said plurality of terminals are made to have a smaller outer diameter as their positions are remoter from said housing.

9. The plug according to claim 1, wherein at least one of said plurality of terminals is constructed with a ring member showing an elastic force to reduce its diameter.

10. The plug according to claim 2, wherein at least one of said plurality of terminals is constructed with a ring member showing an elastic force to reduce its diameter.

11. The plug according to claim 1, wherein at least one of said plurality of terminals is placed in a cavity portion made in said insulator.

12. The plug according to claim 2, wherein at least one of said plurality of terminals is placed in a cavity portion made in said intermediary member.

* * * * *